United States Patent [19]

Schoonmade

[11] Patent Number: 4,521,134

[45] Date of Patent: Jun. 4, 1985

[54] ELEVATING DEVICE FOR AN ARTIFICIAL ISLAND OR WORK PLATFORM

[75] Inventor: Wim Schoonmade, Nieuwerkerk, Netherlands

[73] Assignee: Gusto Engineering B.V., Schiedam, Netherlands

[21] Appl. No.: 476,875

[22] PCT Filed: Jul. 21, 1982

[86] PCT No.: PCT/NL82/00025

§ 371 Date: Mar. 18, 1983

§ 102(e) Date: Mar. 18, 1983

[87] PCT Pub. No.: WO83/00351

PCT Pub. Date: Feb. 3, 1983

[30] Foreign Application Priority Data

Jul. 21, 1981 [NL] Netherlands ..... 8103452

[51] Int. Cl.[3] ..... E02B 17/08; B66F 7/00

[52] U.S. Cl. ..... 405/198; 405/195; 254/95; 254/112

[58] Field of Search ..... 405/198, 195, 196, 199; 254/95, 105, 107–112

[56] References Cited

U.S. PATENT DOCUMENTS

| | | | |
|---|---|---|---|
| 3,014,346 | 12/1961 | Small | 405/198 |
| 3,044,269 | 7/1962 | LeTourneau | 405/198 |
| 3,183,676 | 5/1979 | LeTourneau . | |
| 3,435,621 | 4/1969 | Johnson | 405/198 |
| 3,986,368 | 10/1976 | Levingston . | |
| 4,007,914 | 2/1977 | Sutton | 405/198 X |

FOREIGN PATENT DOCUMENTS

| | | | |
|---|---|---|---|
| 2069404 | 9/1971 | France . | |
| WO80/01181 | 6/1980 | PCT Int'l Appl. | 405/198 |
| 2009825 | 6/1979 | United Kingdom . | |

*Primary Examiner*—Dennis L. Taylor

[57] ABSTRACT

Elevating device for an artificial island or work platform comprising a pontoon 1 or work floor and a number of columns 2 displaceable in vertical direction with respect to the pontoon respectively or work floor by means of the elevating device. At each column 2 the elevating device consists of a number of driving devices having pinions 7–10 meshing with gear racks 3, 4 fixed along the columns 2. In particular concerning its bearing the shafts of the pinions 7–10 are fixed to the pontoon 1 or work floor and consist of a motor, a driving gear and a brake. Each driving device is fixed to respectively form part of a reaction arm 11–14 pivotal around the axis of the output shaft of the driving device. At their one ends 15–19 the reaction arms 11–14 are coupled to the pontoon 1 or work floor through hydraulic cylinders 23–26. At all of the reaction arms 11–14 the hydraulic cylinders 23–26 have a connection 39, 40 from both of the cylinder spaces to a common conduit 41, 42 connecting all of the cylinders 23–26 to each other. Further, means are provided for moving simultaneously all of the valves 31–34 in the closed condition when the motors are put in operation and to open condition when the brakes are put in operation.

1 Claim, 2 Drawing Figures

ELEVATING DEVICE FOR AN ARTIFICIAL ISLAND OR WORK PLATFORM

The invention relates to an elevating device for an artificial island or work platform, comprising a pontoon or work floor and a number of columns displaceable in vertical direction with respect to the pontoon or work floor by means of the elevating device at each column said elevating device consists of a number of driving devices having pinions meshing with gear racks fixed along the column, said driving devices in particular concerning the bearing of the pinion shaft, are fixed to the pontoon or work floor and consist of a motor, a driving gear and a brake.

Such an elevating device is generally known. In said known elevating device one or more pinions mesh with each gear rack and usually, there are several gear racks per column with meshing pinions. Said pinions are driven either by hydraulic motors or by electric motors. During displacement of the pontoon or work floor with respect to the columns and inversely the forces acting on the pinions are automatically balanced. When the motors are stopped the brakes come into operation, in which condition howerver, no balancing of the forces acting on the pinions and thus also on the gear racks exists anymore.

The invention has the object to provide an elevating device whereby said latter may also be obtained completely.

According to the invention said object is achieved in that each driving device is fixed to respectively form part of a reaction arm pivotable around the axis of the output shaft of the driving device, in that the reaction arm is coupled at one end to the pontoon or work floor through a hydraulic cylinder, at all of the reaction arms said hydraulic cylinders have a connection from both of the cylinder spaces to a valve adapted to shut off said connection or to connect both of the cylinder spaces to a common cnduit connecting all of the cylinders to each other and in that means are provided for moving simultaneously all of the valves into the closed condition when the motors are put in operation and to open condition when the brakes are put in operation. In the braked condition the hydraulic connection between the cylinders of the reaction arms performs the compensation of differences in forces.

Now, the invention will be elucidated with reference to the drawings.

Figure 1:
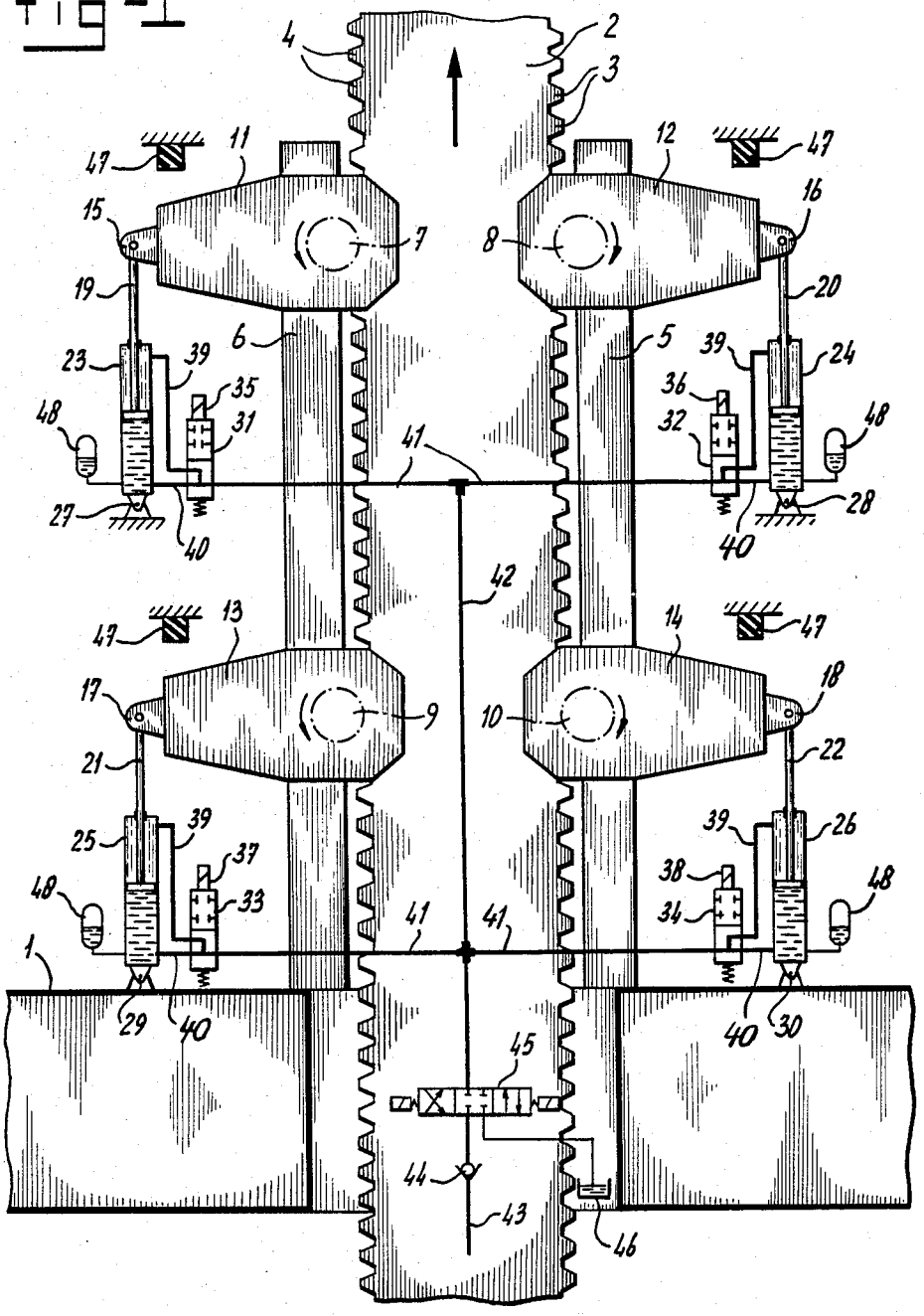
FIG. 1 shows the principle of the invention.

FIG. 1 shows part of a pontoon 1 and a column 2 provided with gear racks 3 and 4 respectively at two opposite edges.

On the pontoon a frame is provided indicated by the parts 5 and 6 schematically.

The circles 8, 10 and 7, 9 indicated by dash-dotted lines represent pinions meshing with the gear racks 3 and 4 respectively.

Pivotable around the axes of pinions 7 to 10 respectively are reaction arms 11, 12, 13 and 14 having ends 15, 16, 17 and 18 respectively which are connected pivotably to piston rods 19, 20, 21 and 22 respectively of hydraulic cyliners 23, 24, 25 and 26.

These cylinders are pivotably fixed to the platform 1 as schematically indicated at 27, 28, 29 and 30 respectively.

Figure 2:
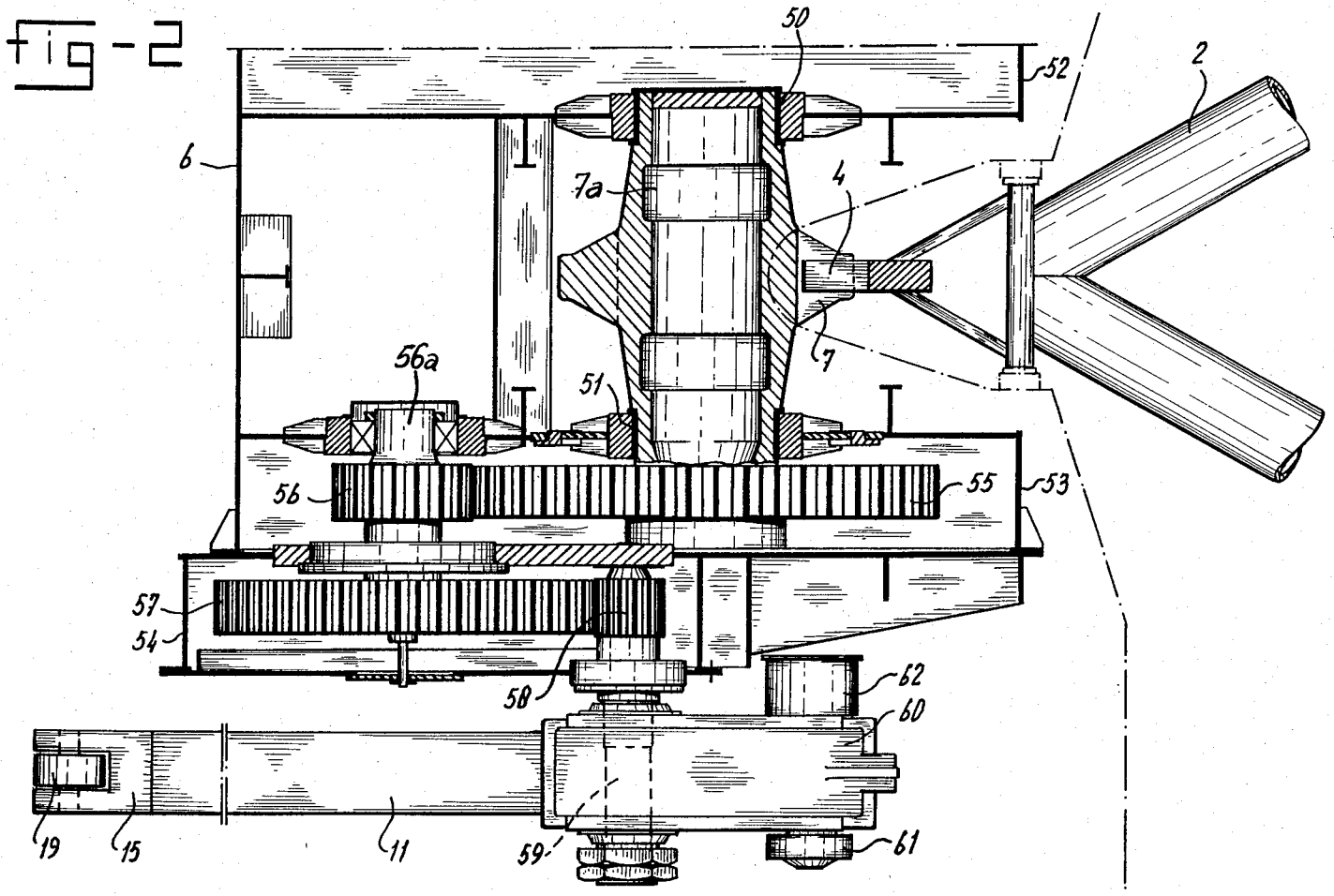
FIG. 2 is partly a view and partly a horizontal section through a driving device of the elevating device according to the invention.

The reaction arms 11 to 14 each support a motor 61, a brake 62 and a gear box 60, not shown in FIG. 1 but in FIG. 2.

Near each cylinder 23, 24, 25 and 26 respectively a valve 31, 32, 33 and 34 respectively is situated which is movable from the open condition shown to a closed condition by means of operating means 35, 36, 37 and 38 respectively shown in the upper half of the valves.

In the open condition shown the space above the piston in each cylinder 23, 24, 25, 26 respectively is connected to the valve through a conduit 39, whereas the space below the piston is connected to the valve through a conduit 40 (see cylinder 23). In the open condition shown of the valves the conduits 39 and 40 communicate with each other as well as with a conduit 41, connecting the cylinders on both sides of a column to each other and connecting all of the cylinders to each other through a connecting conduct 42 when several driving units are superposed.

The conduit system 41, 42 may be supplied with pressurized liquid through a pressure conduit 43 having a one way valve 44 and an operating sliding valve 45. With said sliding valve 45 a liquid may also be drained off to a receptacle 46.

The control is such that during the operation of the elevating device the connections between the cylinders 23 to 26 are shut off. When the brakes 62 (see FIG. 2) come into operation then the valves 31 and 34 come into the open condition shown in FIG. 1 in which in all of the cylinders 23 26 the same pressure ratios prevail and thereby the same loads between the pinions and the gear racks. At 47 rubber stops are shown limiting the movement of the reaction arms. They may also be located at the lower side of the reaction arms. Said stops 47 may absorb the load during transport over sea, in which the cylinders are not pressurized.

If desired in the hydralic compensation system damping accumulators 48 may be provided.

FIG. 2 shows a part of a column 2 with gear rack 4. Meshing with said gear rack is the pinion 7 the shaft *7a* of which is supported in bearings 50 and 51 fixed in sections 52 and 53 of frame 6.

A gear box 54 is fixed to frame 6 and has a large gear 55 supported on the pinion shaft *7a* and in meshing relation with a small gear 56 on the shaft a of which a larger gear 57 is positioned cooperating with a small gear 58 on a shaft 59 of which a driving box 60 is fixed to which box a hydromotor 61 and a brake device 62 are connected.

The box 60 is integral with the reaction arm 11 the end 15 of which is connected to the piston rod 19. Consequently, the box 60 with motor 61 and brake 62 as well as the reaction arm is pivotable around the axis of the small gear 58. Due to the high gearing obtained through the gear boxes 60 and 54, for compensation of differences in load at pinion 7 and gear rack 4 only relative low forces are to be expected in the reaction arms and thereby in the hydraulic compensation system.

If the elevating devices are in operation for raising the platform or lowering the columns then the compensation device is out of operation by holding the valves 31 to 34 in the closed condition and the distribution of the driving forces of two or more driving units is effected hydraulically or electrically through a common supply of the motors.

If the brake forces should be distributed, the valves are brought in the shown open condition by which the reaction forces on the reaction arms can balance each other.

I claim:

1. In a work platform:

a work floor;

a frame on said work floor;

at least one column extending through an opening in said work floor and through said frame and having at least first and second gear racks conected thereto;

means for displacing said at least one column vertically with respect to said work floor and frame;

said means including a plurality of first and second elevating devices respectively associated with said first and second gear rack;

each elevating device comprising: a pinion mounted on said frame and meshing with one of said gear racks; a reaction arm; a motor, a brake and a driving gear having an output shaft, all mounted on said reaction arm; said brake and said motor being operatively connected to said driving gear; said reaction arm being pivotable about said output shaft and having a free end; gearing interposed between said pinion and said driving gear; hydraulic means interposed between said free end of said arm and said work floor, and having a cylinder, a piston in said cylinder and defining therewith a first and second chamber on opposite sides of said piston in said cylinder; a valve associated with each cylinder and having an open position and a closed position; and first and second conduits respectively connecting said first and second conduits to said valve;

and compensation means, common to said plurality of elevating devices, and comprising:

conduit means interconnecting said valves;

and means operatively connected to said valves and to said motors and to said brakes, and operable to move said valves to said closed position in which said conduit means is shut off from said first and second conduits, when said motors are in operation, and to said open position in which said conduit means is connected to said first and second conduits, when said brakes are in operation.

* * * * *